US009809291B2

(12) United States Patent
Galloway

(10) Patent No.: US 9,809,291 B2
(45) Date of Patent: Nov. 7, 2017

(54) APPARATUS AND METHOD FOR ROTATING A SHAFT

(76) Inventor: Eric Galloway, Midlothian (GB)

( * ) Notice: Subject to any disclaimer, the term of this patent is extended or adjusted under 35 U.S.C. 154(b) by 477 days.

(21) Appl. No.: 12/582,403

(22) Filed: Oct. 20, 2009

(65) Prior Publication Data

US 2010/0095791 A1 Apr. 22, 2010

Related U.S. Application Data

(60) Provisional application No. 61/106,713, filed on Oct. 20, 2008.

(51) Int. Cl.

| | |
|---|---|
| ***B63H 23/32*** | (2006.01) |
| ***B63H 23/06*** | (2006.01) |
| ***B63H 23/10*** | (2006.01) |
| ***B63H 23/30*** | (2006.01) |
| *B63H 23/34* | (2006.01) |

(52) U.S. Cl.

CPC ..... *B63H 23/32* (2013.01); *B63H 23/06* (2013.01); *B63H 23/10* (2013.01); *B63H 23/30* (2013.01); *B63H 2023/348* (2013.01); *Y10T 74/19502* (2015.01)

(58) Field of Classification Search

CPC ..... B63H 23/32; B63H 23/06; B63H 23/10; B63H 23/30; B63H 2023/346

USPC ..... 74/380, 384; 474/74; 464/41

See application file for complete search history.

(56) References Cited

U.S. PATENT DOCUMENTS

| | | | | |
|---|---|---|---|---|
| 801,012 | A * | 10/1905 | Howard | F16H 1/16 251/129.03 |
| 3,919,894 | A * | 11/1975 | Keeter | F01D 25/36 60/788 |
| 4,041,422 | A * | 8/1977 | Noji | H03J 1/14 334/49 |
| 4,466,305 | A * | 8/1984 | Hiraiwa | F16H 3/34 74/384 |
| 4,960,006 | A * | 10/1990 | Moore | 74/384 |
| 5,020,386 | A * | 6/1991 | Taig | 74/384 |
| 5,453,035 | A * | 9/1995 | Jenkins | 446/163 |
| 6,685,183 | B2 * | 2/2004 | Kim | 271/114 |
| 6,810,760 | B2 * | 11/2004 | Sye et al. | 74/405 |
| 2004/0099090 | A1 * | 5/2004 | Hsu et al. | 74/665 GA |
| 2007/0289397 | A1 * | 12/2007 | Ritter | 74/22 A |

FOREIGN PATENT DOCUMENTS

| | | | |
|---|---|---|---|
| CN | 101003291 | A * | 7/2007 |
| DE | 4432483 | A1 | 3/1996 |
| EP | 0146353 | A1 | 6/1985 |

(Continued)

OTHER PUBLICATIONS

European Search Report.

*Primary Examiner* — Vicky A Johnson

(74) *Attorney, Agent, or Firm* — Frank J. Dykas; Dykas Law Offices, PLLC

(57) ABSTRACT

Turning gear apparatus (10) for rotating a shaft (11) comprises a rotary drive arrangement (12) and a transmission system including a pivot arm (20). The rotary drive arrangement (12) is fixed, for example to a vessel hull (14), and the pivot arm (20) is pivotable between a first, shaft-disengaged, position and a second, shaft-engaged position where the rotary drive arrangement (12) is operably coupled to the shaft (11), thereby permitting control over rotation of the shaft (11) by the rotary drive arrangement (12).

18 Claims, 4 Drawing Sheets

(56) References Cited

FOREIGN PATENT DOCUMENTS

| | | | | | |
|---|---|---|---|---|---|
| EP | 1123865 | A1 | | 8/2001 | |
| EP | 1491764 | | | 12/2004 | |
| JP | 55054724 | A | * | 4/1980 | ..... F16D 11/10 |
| JP | 60157992 | | | 8/1985 | |
| JP | 1964435 | | | 8/1995 | |
| WO | WO02085703 | A1 | | 10/2002 | |

* cited by examiner

APPARATUS AND METHOD FOR ROTATING A SHAFT

FIELD OF THE INVENTION

This invention relates to an apparatus and method for rotating a shaft and, in particular, but not exclusively, to turning gear for use in a sea-going vessel.

BACKGROUND OF THE INVENTION

A number of systems have been developed to drive rotation of the propeller shaft or shafts of a sea-going vessel. For example, a steam turbine, gas turbine, combustion engine, electric motor or the like may be used to drive rotation of the shaft, either directly or via a reduction gearing arrangement.

During operation, the shaft can often become hot and may be subject to a degree of expansion and it has been found that, when rotation of the shaft is stopped, the static shaft may be susceptible to distortion in the form of sagging, bowing or other damaging temperature effects. In order to overcome or mitigate damage to the shaft, turning gear may be employed to provide continuous, relatively slow rotation of the shaft when the turbine or other drive is not in operation; continuous rotation of the shaft assisting in preventing shaft distortion.

The turning gear may also be used to rotate the shaft from rest, thereby reducing the start-up torque required to initially rotate the shaft prior to engagement of the turbine or other drive.

Furthermore, the turning gear may be used to hold the shaft stationary in order to facilitate repair or maintenance of the shaft as required.

It will be recognised that significant loads may be transmitted through the turning gear and the shaft and, for example, with regard to larger vessels, it has been found that reaction loads generated in the turning gear mechanism due to shock loading can result in damage to the turning gear.

SUMMARY OF THE INVENTION

According to a first aspect of the present invention, there is provided turning gear apparatus for rotating a shaft, the apparatus comprising:

a rotary drive arrangement adapted to be fixed to a vessel hull; and a transmission system coupled to the rotary drive arrangement, the transmission system adapted to be pivoted to engage with the shaft to permit rotation of the shaft by the rotary drive arrangement.

The transmission system may be adapted to be pivoted between a first, disengaged position and a second, shaft-engaging position.

As the rotary drive arrangement is fixed, the apparatus is not required to move the mass of the rotary drive arrangement when engaging the transmission system with the shaft. Accordingly, reaction loads generated as a result of shock loading on the apparatus may be mitigated or substantially eliminated.

The rotary drive arrangement may comprise any suitable arrangement. For example, the rotary drive arrangement may comprise a motor and, in particular embodiments, the rotary drive arrangement may comprise a hydraulic motor, electric motor or the like. As the rotary drive arrangement is fixed to the vessel hull, power transmission to the rotary drive arrangement may also be fixed, this removing the requirement for complicated rotary or compliant power transmission couplings as may otherwise be required.

The apparatus may further comprise a first driven member coupled to the rotary drive arrangement. The first driven member may be fixed to a drive shaft of the rotary drive arrangement and may be adapted for rotation by the rotary drive arrangement about a drive shaft axis.

The rotary drive arrangement may be operatively coupled to the transmission system via the first driven member.

The transmission system may comprise a pivot arm or the like. The provision of a pivot arm facilitates selective engagement between the rotary drive arrangement and the shaft.

The transmission system may be substantially balanced about the drive shaft axis, this assisting in substantially reducing the structural loading requirements of the apparatus in the event of shock loading.

The transmission system may further comprise a second driven member adapted to engage the first driven member.

In particular embodiments, the second driven member may be rotatably coupled to the pivot arm such that rotation of the first driven member is adapted to drive rotation of the second driven member about a second driven member central axis.

The second driven member may be adapted to orbit the first driven member on pivoting of the transmission system. The first and second driven members may be engaged to facilitate alignment between the second driven member and the shaft during pivoting of the transmission system relative to the shaft. For example, engagement between the first and second driven members may ensure that the second driven member maintains a parallel alignment with respect to the shaft during engagement and disengagement between the second driven member and the shaft.

The first and second driven members may be of any suitable form. For example, but not exclusively, each of the first and second driven members may comprise a gear. In particular embodiments, the first and second driven members comprise pinion gears, though helical gears, spur gears or other suitable driven members may be used where appropriate. Thus, for example, where the first and second driven members comprise gears, the first and second driven members may be arranged so that the respective gear profiles mesh.

Furthermore, the second driven member may be adapted to engage a further driven member on the shaft to be rotated. For example, the further driven member may comprise a shaft gear fixed to the shaft, the shaft gear adapted to facilitate rotation of the shaft by the second driven member. Where, for example, the second driven member and further driven member comprise gears, the gear profiles may be configured to facilitate meshing of the second driven member and shaft gear. In particular, the gear profiles may advantageously be formed to reduce or overcome tip interference.

The apparatus may further comprise an actuator for pivoting the transmission system between the first position and the second position and vice-versa. In particular embodiments, the actuator may be adapted to transmit a moment force to the transmission system about a pivot axis.

The actuator may be of any appropriate form. For example, the actuator may comprise a screw jack. Alternatively, or in addition, the actuator may comprise a hydraulic ram, pneumatic actuator or other suitable actuator. Advantageously, location of the rotary drive arrangement off the transmission system reduces the load requirement of the actuator and facilitates the use of a smaller, more compact actuator. Furthermore, shock loading transmitted to the actuator may be reduced.

The apparatus may further comprise a control system for controlling engagement between the apparatus and the shaft to be rotated. The control system may, for example, comprise speed sensors adapted to facilitate synchronisation of the apparatus and the shaft.

According to another aspect of the present invention there is provided turning gear apparatus for rotating a shaft, the apparatus comprising:

a rotary drive arrangement adapted to be fixed to a vessel hull;

a first driven member coupled to the rotary drive arrangement;

a second driven member rotatably coupled to the first driven member, the second driven member coupled to a pivot arm, wherein the pivot arm is adapted to be pivoted to engage the second driven member with the shaft to permit rotation of the shaft by the rotary drive arrangement.

Aspects of the present invention also relate to a method of rotating a shaft, the method comprising:

pivoting a transmission system between a first disengaged position and a second, shaft engaging position; and operating a rotary drive arrangement which is coupled to the transmission system and which is fixed to a vessel hull to permit rotation of the shaft via the transmission system.

The method may further comprise synchronising at least one of: rotation of the drive arrangement, rotation of the first driven member, rotation of the second driven member, pivoting of the transmission system and rotation of the shaft.

The method may comprise moving the apparatus between the first, disengaged position and the second, engaged, position in a single stage.

Alternatively, the apparatus may be moved between the first, disengaged position and the second, engaged, position in a plurality of stages. For example, the apparatus may be brought into a stand-off position close to, but not in, full engagement with the shaft. The method may further comprise measuring the speed of rotation of the shaft and adapting the apparatus to facilitate engagement between the second driven member and the shaft.

BRIEF DESCRIPTION OF THE DRAWINGS

These and other aspects of the present invention will now be described with reference to the accompanying drawings, in which.

DETAILED DESCRIPTION OF THE DRAWINGS

FIGS. 1 to 5 show turning gear apparatus 10 in accordance with an embodiment of the present invention. The apparatus 10 is adapted to engage and rotate a shaft, such as a propeller shaft 11 (FIGS. 4 and 5) of a sea-going vessel.

Figure 1:
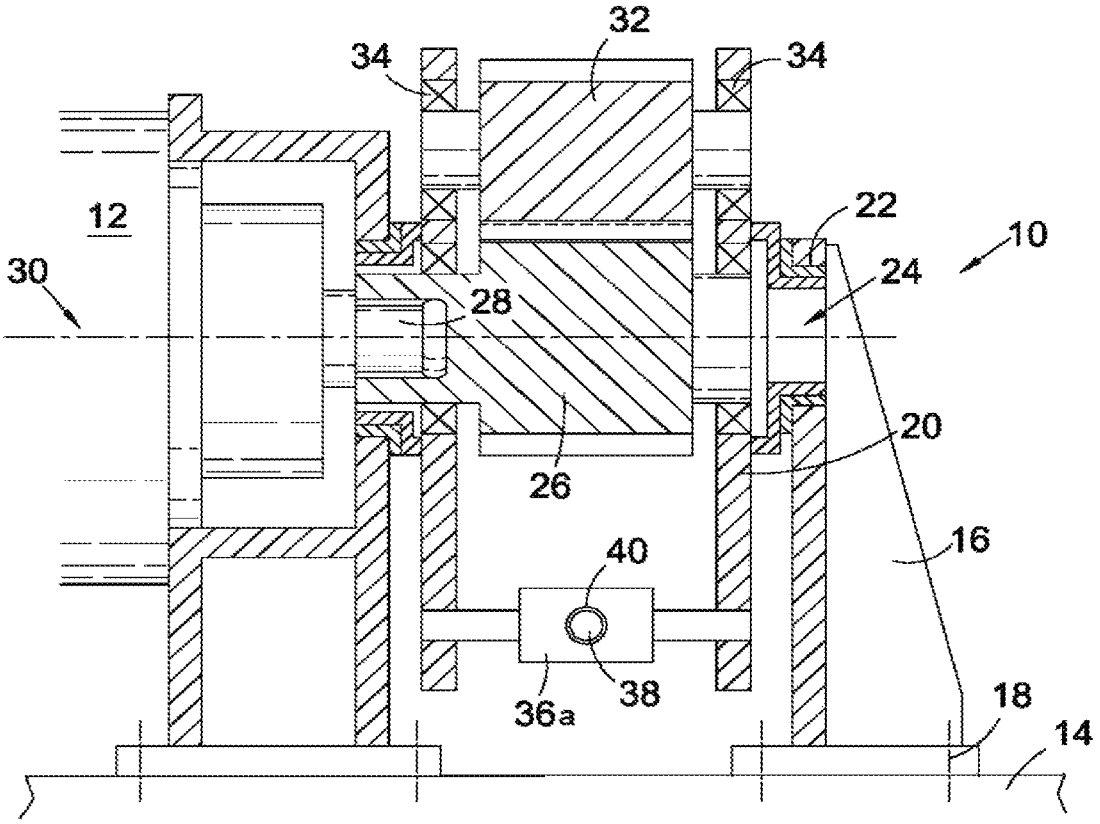
FIG. 1 is a diagrammatic longitudinal cross-sectional view of an apparatus for rotating a shaft according to an embodiment of the present invention.
Figure 2:
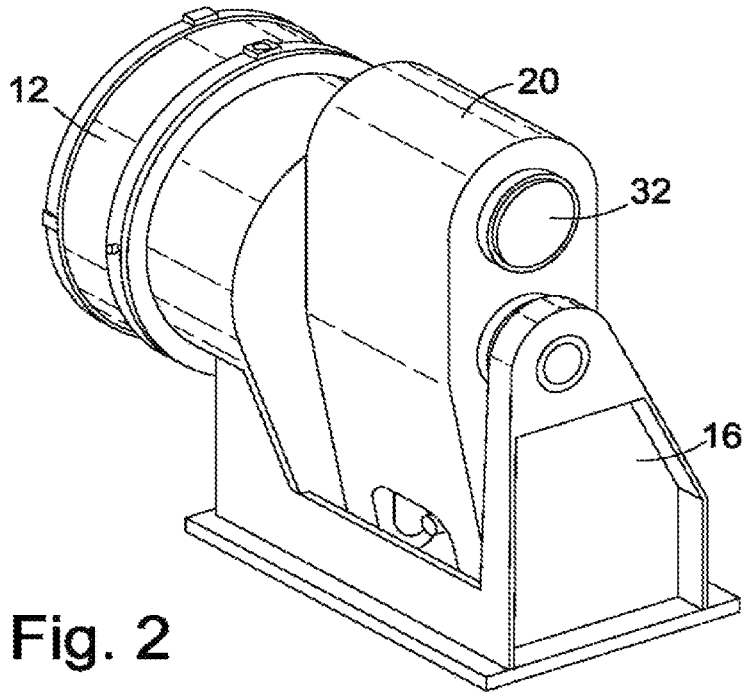
FIG. 2 is a perspective view of the apparatus of FIG. 1.
Figure 3:
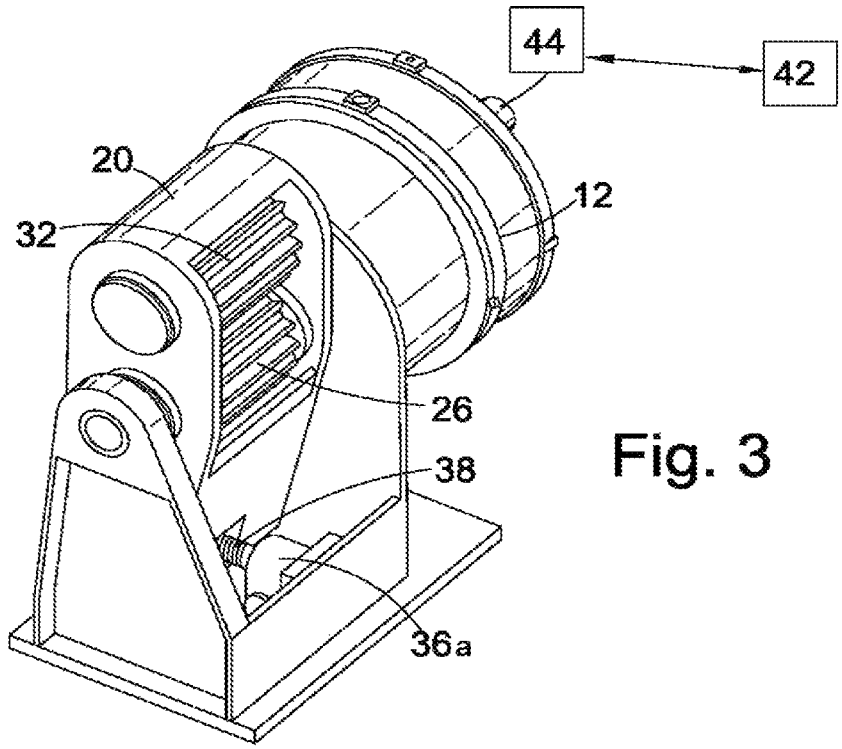
FIG. 3 is an alternative perspective view of the apparatus of FIGS. 1 and 2.

With reference to FIGS. 1 to 3, the apparatus 10 comprises a rotary drive arrangement in the form of a hydraulic motor 12 which is fixed to a vessel hull 14 via a base bracket 16. The bracket 16 is secured to the hull 14 by a bolted connection 18, though any suitable arrangement for securing the bracket 16 may be used.

The apparatus 10 further comprises a transmission system which includes a pivot arm 20 coupled to the bracket 16 by a bearing 22. The bearing 22 comprises a radial bearing, though any suitable bearing member may be employed and the pivot arm 20 is thus adapted for rotational movement about a pivot axis 24.

The apparatus 10 further comprises a first driven member in form of a pinion gear 26 mounted on a drive shaft 28 of the motor 12. The motor drive shaft 28 extends towards the pivot arm 20 and defines a drive shaft rotational axis 30. In the embodiment shown in the drawings, the pivot axis 24 and drive shaft axis 30 are co-linear and the first pinion gear 26 is adapted for rotation about the pivot arm axis 24/drive shaft axis 30.

The transmission system also includes a driven member in the form of a second pinion gear 32. The second pinion gear 32 is rotatably mounted on the pivot arm 20 by a radial bearing 34 and is arranged so that the second driven member 32 meshes with the first pinion gear 26.

As shown in FIGS. 2 and 3, the pivot arm 20 forms an enclosure or hood over the first and second pinion gears 26, 32 which assists in protecting the gears 26, 32.

The apparatus 10 further comprises an actuator in the form of a screw jack **36*a* fixed to the bracket 16. The screw jack 36*a* comprises a threaded portion or screw 38 which is adapted to engage a corresponding threaded portion 40 on the pivot arm 20**.

The apparatus 10 further comprises a control system 42 (shown schematically in FIG. 3) for controlling movement and synchronisation of the motor 12, pivot arm 20, pinion gears 26, 32 and screw jack **36*a*** with the shaft to be rotated.

The control system 42 comprises sensors 44 for monitoring the speed of rotation of the components of the apparatus 10 to facilitate engagement between the apparatus 10 and the shaft. Communication signals between the control system 42, sensors 44 and apparatus 10 may be of any suitable form including for example, electrical signals, optical signals, wireless signals, radio frequency signals or the like.

Figure 4:
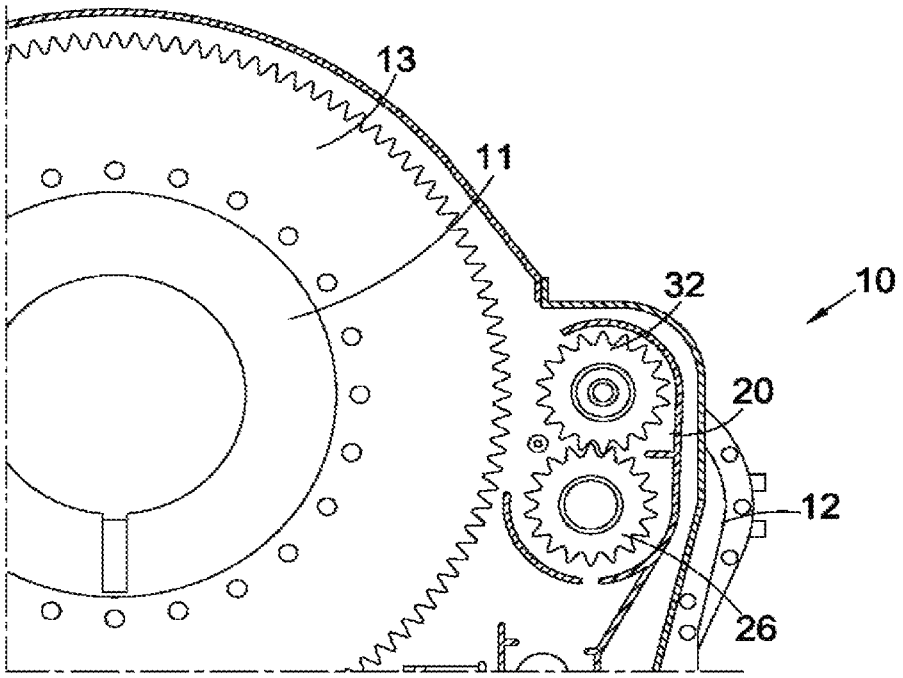
FIG. 4 is a cross-sectional view of a portion of the apparatus of FIGS. 1 to 3, the apparatus shown in a first, disengaged, position relative to a shaft.
Figure 5:
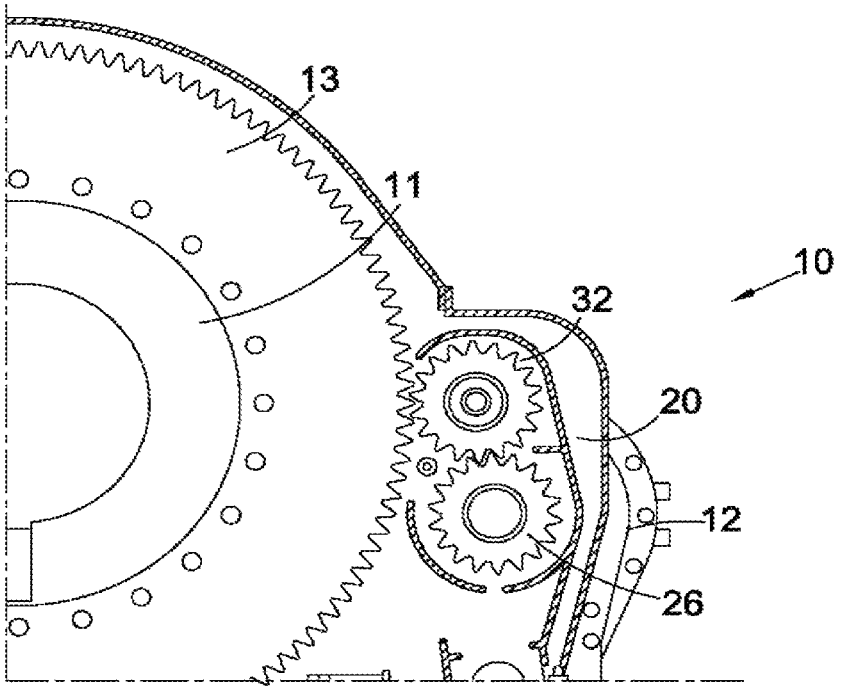
FIG. 5 is a cross-sectional view of the portion of the apparatus of FIG. 4, the apparatus shown in a second, engaged, position relative to the shaft.

Referring now in particular to FIGS. 4 and 5 of the drawings, the apparatus 10 initially defines a first, disengaged, position relative to the shaft 11, the first position shown in FIG. 4. In operation, the motor 12 drives rotation of the first pinion gear 26 about the axis 30 (FIG. 1). The first pinion gear 26 is in mesh with the second pinion gear 32 such that rotation of the first pinion gear 26 in turn rotates the second pinion gear 32.

Due to the inter-engaging threads of the screw 38 and threaded portion 40 of the pivot arm 20, rotation of the screw 38 causes the threaded portion 40 to walk along the screw 38, thereby producing a moment on the pivot arm 20. Accordingly, the pivot arm is rotated about axis 24 (FIG. 1) from the first disengaged position shown in FIG. 4 to a second, engaged, position as shown in FIG. 5.

As the motor 12 is fixed to the vessel hull 14, reaction loads from any shock loads in the arm are low, reduced or substantially eliminated. Any overturning moment on the pivot arm 20 and pivot arm bearing 22 is also low, reduced or eliminated. Furthermore, any overturning load transmitted through the bracket 16 to the bolted connection 18 is low, reduced or eliminated.

As the pivot arm 20 pivots, the second pinion gear 32 moves around or orbits the first pinion gear 26 and moves from the first, disengaged position to engage with and mesh with a ring gear 13 on the shaft 11. As an example, where the pitch circle diameter (PCD) of the pinion gears 26, 32 is about 288 mm and the pinion gear disengagement travel is about 70 mm, the pivot arm 20 will rotate about 14 degrees and the screw jack 36*a* will have a stroke of about 105 mm.

On engaging the ring gear 13, the shaft 11 is rotated by the motor 12 via the first and second pinion gears 26, 32 and the shaft ring gear 13.

During engagement and disengagement of the apparatus 10 with the shaft ring gear 13, the motor 12 is operated in a low pressure looped mode to assist in avoiding binding of the gear teeth.

The control system 42 matches the rotational speed of the second driven member 32 to the shaft/shaft ring gear 13 to facilitate engagement between the apparatus 10 and the shaft 11. In one embodiment, the control system 42 is adapted to facilitate engagement between the apparatus 10 and the shaft 11 in a single stage. Alternatively, the control system 42 may be adapted to facilitate engagement between the apparatus 10 and the shaft 11 in a plurality of stages. Each stage may involve processing feedback information from speed sensors located on the apparatus 10 and the shaft 11.

Those of skill in the art will recognise that the illustrated apparatus is merely exemplary of the present invention and that the same objectives may be achieved by using a variety of different configurations.

For example, while the present invention is described for use in respect of the shaft of a sea-going vessel, the invention can be used to rotate any shaft.

As shown in the Figures, a single turning gear apparatus may be used to engage and rotate the shaft. Alternatively, a plurality of turning gear apparatus may be used to rotate the shaft. For example, two turning gear apparatus may be positioned on either side of an end of the shaft. Alternatively, or in addition, turning gear apparatus may be positioned at spaced locations along the length of the shaft or at respective ends of the shaft, where appropriate.

The apparatus may be adapted to engage the shaft to permit control over rotation of the shaft. For example, the transmission system may be adapted to engage the shaft to permit the shaft to be rotated from rest, thereby reducing the start-up torque required to initially rotate the shaft prior to engagement of a turbine or other drive. Alternatively, or in addition, the transmission system may be adapted to engage the shaft to permit the shaft to be decelerated and/or held stationary for example to facilitate repair or maintenance of the shaft as required.

Figure 6:
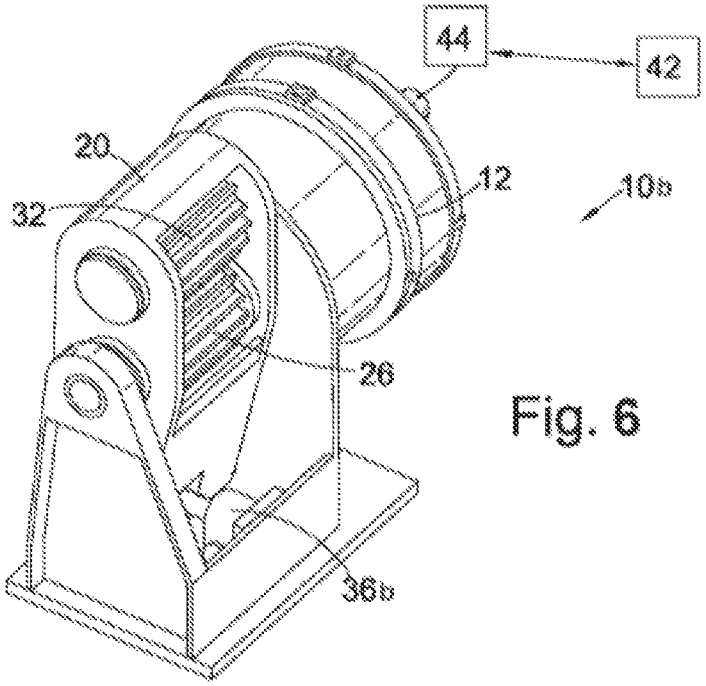
FIG. 6 is a perspective view of an apparatus for rotating a shaft according to an alternative embodiment of the present invention.

FIG. 6 shows an apparatus 10*b* according to an alternative embodiment of the present invention. The apparatus 10*b* is identical to the apparatus 10 shown in FIGS. 1 to 5 with the exception that the actuator comprises a hydraulic ram 36*b*.

Figure 7:
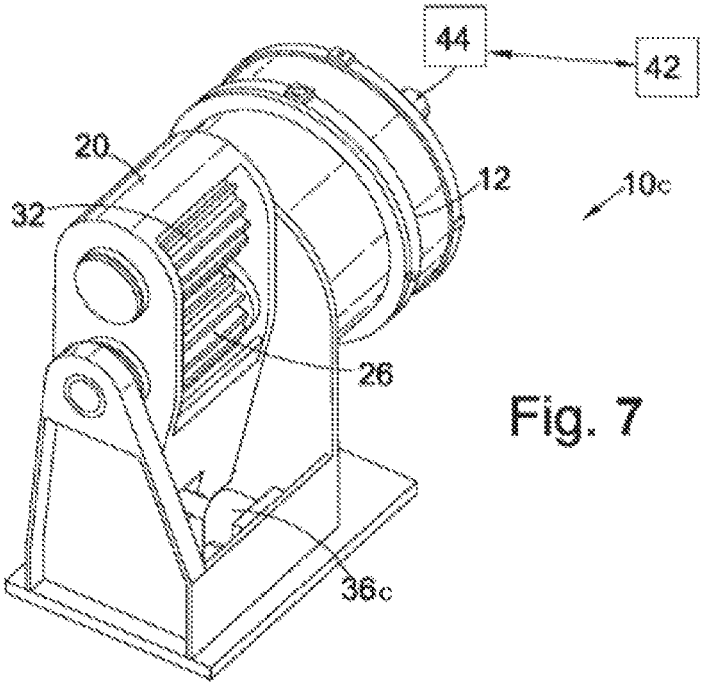
FIG. 7 is a perspective view of an apparatus for rotating a shaft according to a further alternative embodiment of the present invention.

FIG. 7 is a perspective view of an apparatus 10*c* according to a further alternative embodiment of the present invention. The apparatus 10*c* is identical to the apparatus 10 shown in FIGS. 1 to 5 with the exception that the actuator comprises a pneumatic actuator 36*c*.

What is claimed is:

1. Turning gear apparatus for rotating a shaft, the apparatus comprising:

a rotary drive arrangement adapted to be fixed to a vessel hull;

a transmission system coupled to the rotary drive arrangement, the transmission system comprising a pivot arm adapted to be pivoted about a pivot axis to engage the transmission system with the shaft to permit rotation of the shaft by the rotary drive arrangement, a first driven member coupled to and adapted for rotation by the rotary drive arrangement, and a second driven member adapted to be driven by the first driven member; and an actuator for pivoting said pivot arm about said pivot axis between a first position and a second position, and vice versa, wherein said pivot arm is disposed about said pivot axis, said pivot axis being co-linear with a drive shaft axis of said rotary drive arrangement, wherein a first part of said pivot arm is disposed on one side of said drive shaft axis and a second part of said pivot arm is disposed on an opposing side of the drive shaft axis from said first part of said pivot arm, wherein said actuator is physically coupled to said first part of said pivot arm and the second driven member is disposed on said second part of said pivot arm, wherein the actuator is coupled to a lower portion of the pivot arm and configurable to pivot the pivot arm so that a driven member rotatably coupled to an upper portion of the pivot arm engages with the shaft to permit rotation or the shaft by the rotary drive arrangement.

2. The apparatus of claim 1, wherein the rotary drive arrangement is operably coupled to the transmission system via the first driven member.

3. The apparatus of claim 1, wherein the first and second driven members are engaged to facilitate alignment between the second driven member and the shaft during pivoting of the transmission system relative to the shaft.

4. The apparatus of claim 1, wherein the second driven member is adapted to orbit the first driven member on pivoting of the transmission system.

5. The apparatus of claim 1, wherein each of the first and second driven members comprises a gear.

6. The apparatus of claim 1, wherein the second driven member is adapted to engage a further driven member on the shaft.

7. The apparatus of claim 6, wherein the further driven member comprises a gear provided on the shaft, whereby rotation of the second driven member drives rotation of the shaft.

8. The apparatus of claim 1, wherein the actuator is selected from the group consisting of: a screw jack; a hydraulic ram; and a pneumatic actuator.

9. The apparatus of claim 1, wherein the actuator is fixed to a mounting bracket of the apparatus.

10. A method of rotating a shaft, the method comprising:

providing a turning gear apparatus comprising: a rotary drive arrangement adapted to be fixed to a vessel hull; a transmission system coupled to the rotary drive arrangement, the transmission system comprising a pivot arm adapted to be pivoted about a pivot axis to engage the transmission system with the shaft to permit rotation of the shaft by the rotary drive arrangement, a first driven member coupled to and adapted for rotation by the rotary drive arrangement, and a second driven member adapted to be driven by the first driven member; and an actuator for pivoting said pivot arm about said pivot axis between a first, disengaged, position and a second, shaft-engaging, position, and vice versa, wherein said pivot arm is disposed about said pivot axis, said pivot axis being co-linear with a drive shaft axis of said rotary drive arrangement, wherein a first part of said pivot arm is disposed on one side of said drive shaft axis and a second part of said pivot arm is disposed on an opposing side of the drive shaft axis from said first part of said pivot arm, wherein said actuator is physically coupled to said first part of said pivot arm and the second driven member is disposed on said second part of said pivot arm, wherein the actuator is coupled to a lower portion of the pivot arm so that a driven member rotatably coupled to an upper portion of the pivot arm engages with the shaft to permit rotation of the shaft by the rotary drive arrangement;

pivoting said pivot arm between said first, disengaged, position and said second, shaft engaging, position using said actuator; and operating said rotary drive arrangement to permit rotation of the shaft via the transmission system.

11. The method of claim 10, comprising moving the transmission system between the first, disengaged, position and the second, engaged, position in a single stage.

12. The method of claim 10, comprising moving the transmission system between the first, disengaged, position and the second, engaged, position in a plurality of stages.

13. The method of claim 10, comprising synchronising at least one of: rotation of the drive arrangement, rotation of the first driven member, rotation of the second driven member, pivoting of the transmission system and rotation of the shaft.

14. The method of claim 10, wherein the actuator is selected from the group consisting of: a screw jack; a hydraulic ram; and a pneumatic actuator.

15. The method of claim 10, wherein the actuator is fixed to a mounting bracket of the apparatus.

16. The method of claim 10, comprising pivoting said pivot arm between said second position and said first position using said actuator, wherein the actuator is configured, via said physical coupling between said actuator and said pivot arm, to transmit a moment force which pivots said pivot arm in a second rotational direction about said pivot axis in order to disengage said transmission system from said shaft.

17. Turning gear apparatus for rotating a shaft, the apparatus comprising:

a rotary drive arrangement adapted to be fixed to a vessel hull;

a transmission system coupled to the rotary drive arrangement, the transmission system comprising a pivot arm adapted to be pivoted about a pivot axis to engage the transmission system with the shaft to permit rotation of the shaft by the rotary drive arrangement, a first driven member coupled to and adapted for rotation by the rotary drive arrangement, and a second driven member adapted to be driven by the first driven member;

an actuator for pivoting said pivot arm about said pivot axis between a first position and a second position, and vice versa; and a control system for controlling engagement between engagement between the apparatus and the shaft to be rotated, the control system comprising speed sensors adapted to facilitate synchronisation of the apparatus and the shaft, wherein said pivot arm is disposed about said pivot axis, said pivot axis being co-linear with a drive shaft axis of said rotary drive arrangement, wherein a first part of said pivot arm is disposed on one side or said drive shaft axis and a second part of said pivot arm is disposed on an opposing side of the drive shaft axis from said first part of said pivot arm, and wherein said actuator is physically coupled to said first part of said pivot arm and the second driven member is disposed on said second part of said pivot arm a control system for controlling engagement between the apparatus and the shaft to be rotated, the control system comprising speed sensors adapted to facilitate synchronization of the apparatus and the shaft.

18. A method of rotating a shaft, the method comprising:

providing a turning gear apparatus comprising:

a rotary drive arrangement adapted to be fixed to a vessel hull;

a transmission system coupled to the rotary drive arrangement, the transmission system comprising a pivot arm adapted to be pivoted about a pivot axis to engage the transmission system with the shaft to permit rotation of the shaft by the rotary drive arrangement, a first driven member coupled to and adapted for rotation by the rotary drive arrangement, and a second driven member adapted to be driven by the first driven member; and an actuator for pivoting said pivot arm about said pivot axis between a first, disengaged, position and a second, shaft-engaging, position, and vice versa, wherein said pivot arm is disposed about said pivot axis, said pivot axis being co-linear with a drive shaft axis of said rotary drive arrangement, wherein a first part of said pivot arm is disposed on one side of said drive shaft axis and a second part of said pivot arm is disposed on an opposing side of the drive shaft axis from said first part of said pivot arm, and wherein said actuator is physically coupled to said first part of said pivot arm and the second driven member is disposed on said second part of said pivot arm;

and a control system for controlling engagement between the apparatus and the shaft to be rotated, the control system comprising speed sensors adapted to facilitate synchronisation of the apparatus and the shaft;

pivoting said pivot arm between said first, disengaged, position and said second, shaft engaging, position using said actuator; and operating said rotary drive arrangement to permit rotation of the shaft via the transmission system.

* * * * *